US010218120B2

(12) United States Patent
Sone

(10) Patent No.: US 10,218,120 B2
(45) Date of Patent: Feb. 26, 2019

(54) CONNECTOR DEVICE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kosuke Sone, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/772,676

(22) PCT Filed: Nov. 8, 2016

(86) PCT No.: PCT/JP2016/083026
§ 371 (c)(1),
(2) Date: May 1, 2018

(87) PCT Pub. No.: WO2017/082228
PCT Pub. Date: May 18, 2017

(65) Prior Publication Data

US 2018/0316140 A1 Nov. 1, 2018

(30) Foreign Application Priority Data

Nov. 10, 2015 (JP) ..... 2015-220129

(51) Int. Cl.
*H01R 13/631* (2006.01)
*H01R 13/518* (2006.01)

(52) U.S. Cl.
CPC ..... *H01R 13/6315* (2013.01); *H01R 13/518* (2013.01)

(58) Field of Classification Search
CPC ..... H01R 13/6315; H01R 13/518
(Continued)

(56) References Cited

U.S. PATENT DOCUMENTS 4,900,261 A * 2/1990 Gentry ..... H01R 13/6273 439/353
6,171,125 B1 * 1/2001 Kirkendall ..... H01R 13/64 439/218
(Continued)

FOREIGN PATENT DOCUMENTS

JP 2006-4840 1/2006
JP 2010-267488 11/2010
(Continued)

OTHER PUBLICATIONS

International Search Report dated Dec. 13, 2016.

*Primary Examiner* — Alexander Gilman
(74) *Attorney, Agent, or Firm* — Gerald E. Hespos; Michael J. Porco; Matthew T. Hespos

(57) ABSTRACT

It is aimed to enable a plurality of device-side connectors and a plurality of holding-side connectors to be collectively connected without enlarging the device-side connectors. Device-side connectors (3) are mounted on respective juxtaposed solenoids (1). Holding-side connectors (7) corresponding to these device-side connectors are mounted on a holder (18) via coupling members (19). A guiding groove (8) including a positioning portion (8A) is formed on the solenoid (1), and a guide portion (9) is formed on the coupling member (19) of the holding-side connector (7). The guide portion (9) corrects the posture of the holding-side connector (7) by the positioning portion (8A), whereby the device-side connector (3) and the holding-side connector (7) are guided to be opposed to each other.

5 Claims, 11 Drawing Sheets

(58) Field of Classification Search
USPC ..... 439/374
See application file for complete search history.

(56) References Cited

U.S. PATENT DOCUMENTS

| | | | | |
|---|---|---|---|---|
| 7,179,111 | B2 * | 2/2007 | Van Der Mee .... | H01R 13/6273<br>439/357 |
| 7,179,130 | B2 * | 2/2007 | Judge ..... | H01R 27/02<br>439/188 |
| 9,153,907 | B2 * | 10/2015 | Yu ..... | H01R 13/6278 |
| 9,653,894 | B2 * | 5/2017 | Kitamura ..... | H01R 13/64 |
| 9,667,045 | B2 * | 5/2017 | Kitamura ..... | H01R 13/64 |
| 9,698,523 | B2 * | 7/2017 | Kitamura ..... | H01R 13/5829 |
| 2005/0282426 | A1 * | 12/2005 | Nagashima ..... | H01R 13/6315<br>439/374 |
| 2016/0344137 | A1 * | 11/2016 | Sone ..... | F16H 61/0006 |

FOREIGN PATENT DOCUMENTS

| | | |
|---|---|---|
| JP | 5303378 | 10/2013 |
| JP | 2014-127308 | 7/2014 |
| JP | 2015-103315 | 6/2015 |

* cited by examiner

CONNECTOR DEVICE

BACKGROUND

Field of the Invention

The present invention relates to a connector device.

Description of the Related Art

Publication of Japanese Patent No. 5303378 discloses an outer housing to be fixed to a case. The outer housing includes a tubular accommodating portion for accommodating an inner housing. Springs are provided in the accommodating portion for displaceably accommodating the inner housing. The springs are arranged between an inner wall of the accommodating portion and the inner housing and absorb a positional deviation between the inner housing and the mating housing when the inner housing is connected to a mating connector.

The inner housing may not easily move to a position for connection to the mating connector if the mating connector is provided on an electrical device that is state movable beyond a resilient range of the springs, and a connecting operation may not be performed smoothly in this situation. Further, a workload is large if the inner housing is connected to each of several juxtaposed mating connectors.

An opening part of one connector may be widened to form a conical guide that is intended to absorb a deviation of a connection center line between two connectors. However, the widened guide enlarges the connector.

The invention was completed on the basis of the above situation and aims to provide a connector device enabling device-side connectors and holding-side connectors to be connected collectively without enlarging the device-side connectors.

SUMMARY

The invention is directed to a connector device with device-side connectors installed on outer surfaces of electrical devices that are juxtaposed in a width direction. The connector device also includes holding-side connectors that are connectable to the corresponding device-side connectors by moving forward from behind the respective device-side connectors. The holding-side connectors are allowed to rotate about axes along a front-rear direction with respect to the device-side connectors. The connector device further includes a holder configured to couple the holding-side connectors in a state juxtaposed in the width direction and enabling the respective holding-side connectors to be connected collectively to the corresponding device-side connectors. Guides are provided for the holding-side connectors on a side where the holding-side connectors are located, and guiding portions extend in the front-rear direction behind the respective device-side connectors on the outer surfaces of the electrical devices. The guiding portions are configured to guide the connection of the holding-side connectors and the device-side connectors by being fit to the respective guides.

The holding-side connectors are mounted on the holder and, in that mounted state, are brought closer to the corresponding device-side connectors. At this time, even if there is a misalignment between the corresponding connectors in the circumferential direction about the axis, the connectors rotate to oppose each other as the holding-side connector approaches the device-side connector through the fitting of the guide and the guiding portion. In this way, the respective holding-side connectors can be connected collectively to the respective device-side connectors.

According to the invention, the guiding portion is not formed on a housing of the device-side connector as before, but is formed on the outer surface of the electrical device. Thus, the device-side connector can be miniaturized.

Each of the guiding portions may be a groove on the outer surface of the electrical device and may be widened toward a rear end. According to this configuration, a good function of guiding the holding-side connectors is exhibited. Additionally, the groove of the guiding portion does not form an unnecessary projection, and the electrical device is not enlarged.

Coupling members may be provided between the respective holding-side connectors and the holder and may be configured to couple the holding-side connectors to the holder. Accordingly, the holding-side connectors are coupled to the holder via the separate coupling members, and mounting locations for the holder are not needed on the holding-side connectors. Thus, the holding-side connectors having an existing form can be utilized as they are.

A wire may be pulled out from a rear surface of each of the holding-side connectors, and each of the coupling members may include two coupling plates facing each other between the rear surface of the corresponding one of the plurality of holding-side connector and the holder. A wire draw-out opening may be open between the coupling plates and may be configured to draw the wire out of the coupling member. According to this configuration, the wire pulled out from the holding-side connector can be pulled out to outside through the wire draw-out opening of the coupling member. Thus, a wire routing process can be performed smoothly.

The guides may be provided on each of the coupling members. Thus, the guides are not formed not on the holding-side connectors, and the holding-side connectors can have an existing form.

Each of the guides may include a base projecting from the corresponding one of the coupling members toward a side where the electrical device is located, and a flange may protrude out in the width direction from a front end part of the base. Each of the guiding portions may be a groove on the outer surface of the electrical device, and a positioning portion on a front part of the groove maybe configured to position the corresponding holding-side connectors in a circumferential direction about the axis by being fit to the base. A flange locking portion may be on a groove bottom side of the positioning portion and may communicate with the positioning portion. The flange locking portion may have a wider groove width in the width direction than the positioning portion and may be configured to lock the flange inserted therein. According to this configuration, the flange is locked to the flange locking portion at an entrance of the positioning portion. Thus, the base and the positioning portion are fit more reliably, and a positional deviation between the holding-side connector and the device-side connector in the circumferential direction can be addressed reliably.

DETAILED DESCRIPTION

One specific embodiment of a connector device of the invention is described with reference to the drawings. In the following description, a vertical direction is based on a use state and corresponds to a direction of gravity. Further, a front side of a holding-side connector in a connecting direction is referred to as a front side concerning a front-rear direction. Specifically, F in figures denotes a front side and R in figures denotes a rear side.

Figure 1:
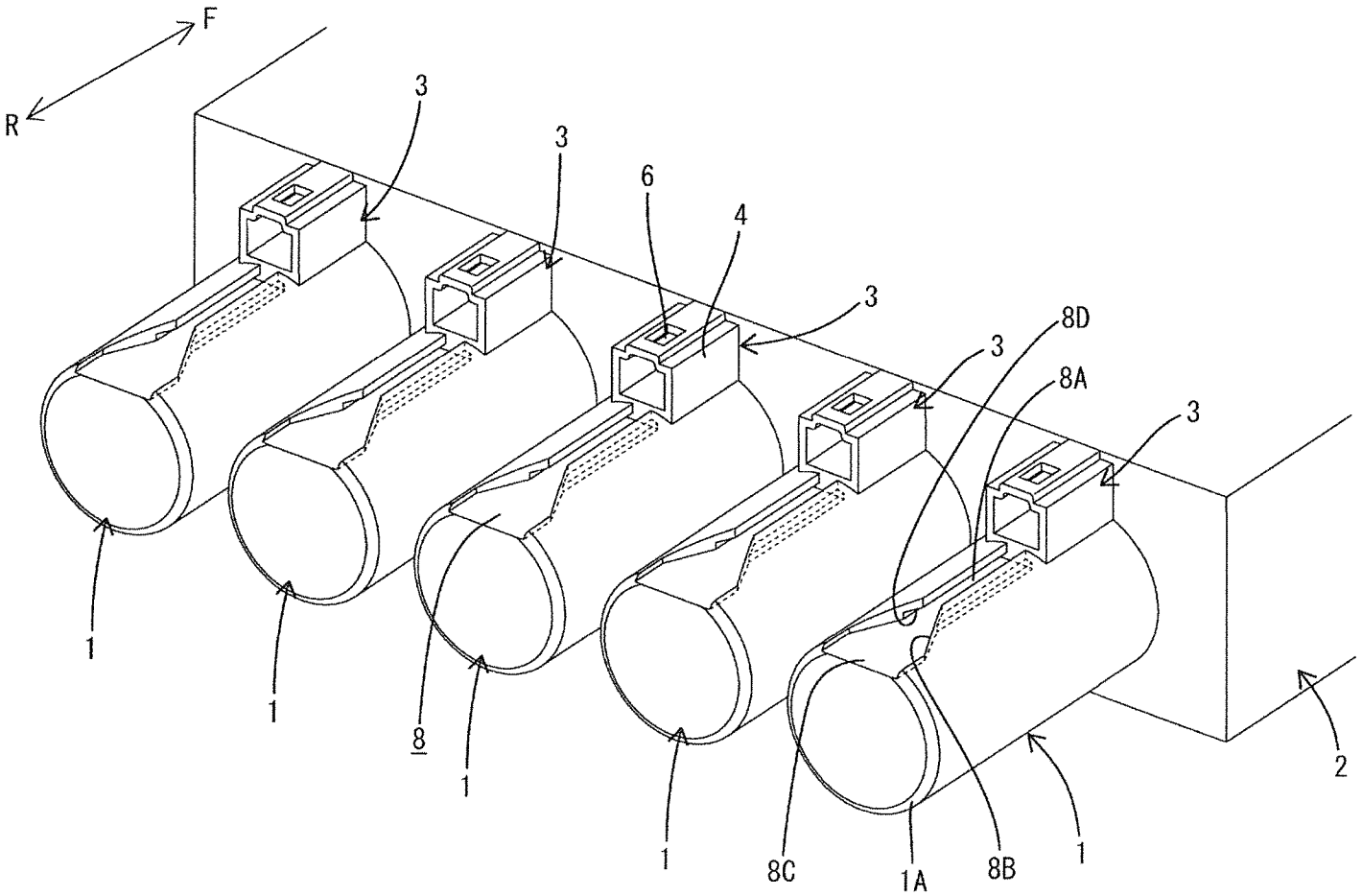
FIG. 1 is a perspective view showing device-side connectors provided on solenoids in one embodiment.

FIG. 1 shows solenoids 1 (electrical devices) for hydraulic control installed in an automatic transmission of an automotive vehicle. A plurality of solenoids 1 are mounted in parallel in a width direction (W in figures) on a body 2 of the automatic transmission. The solenoid 1 has a hollow cylindrical shape and is fixed to project rearward from the rear surface of the body 2, but is allowed to rotate by a small angle (rattle) about an axis. The rear end surface of the solenoid 1 is chamfered 1A over the entire circumference.

Figure 3:
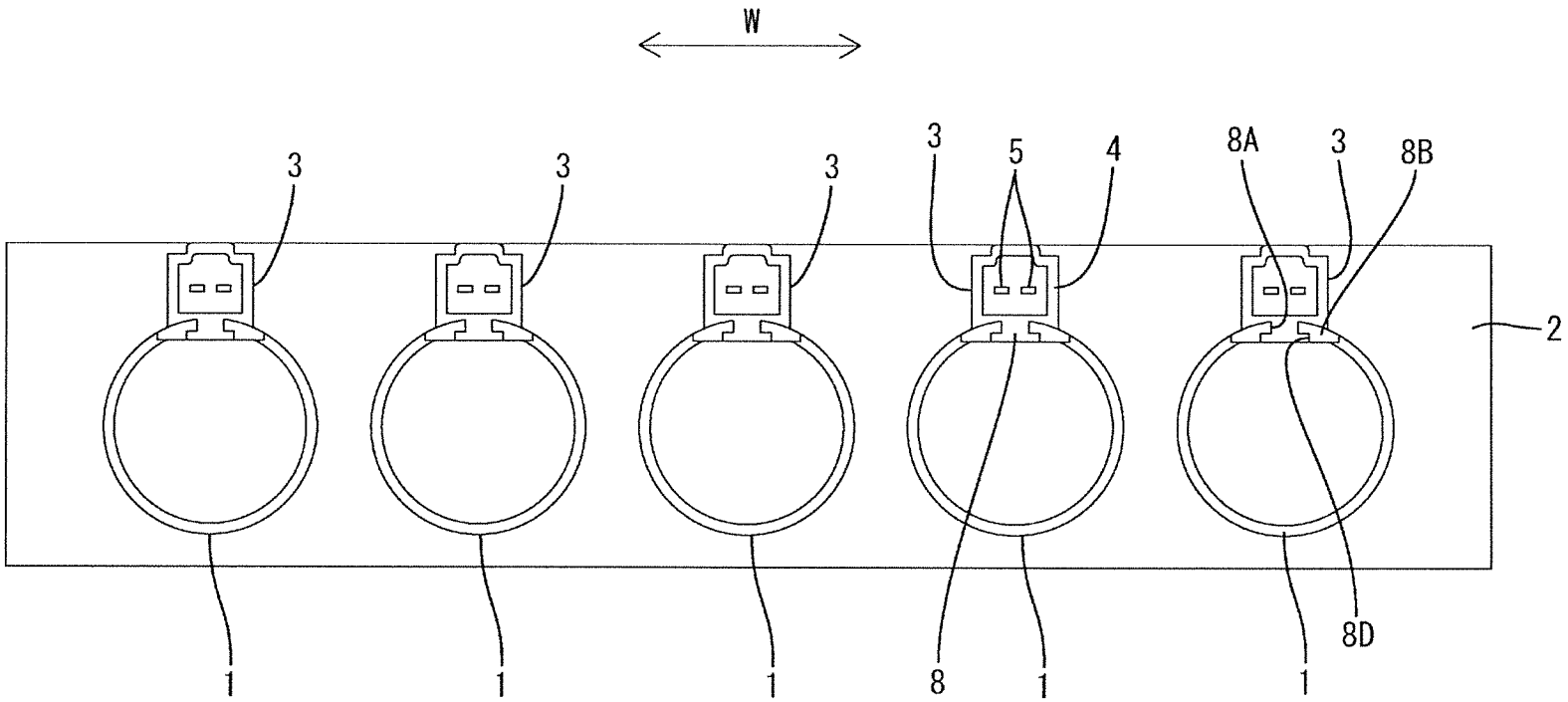
FIG. 3 is a front view showing the state where the holding-side connectors are mounted on the holder.
Figure 6:
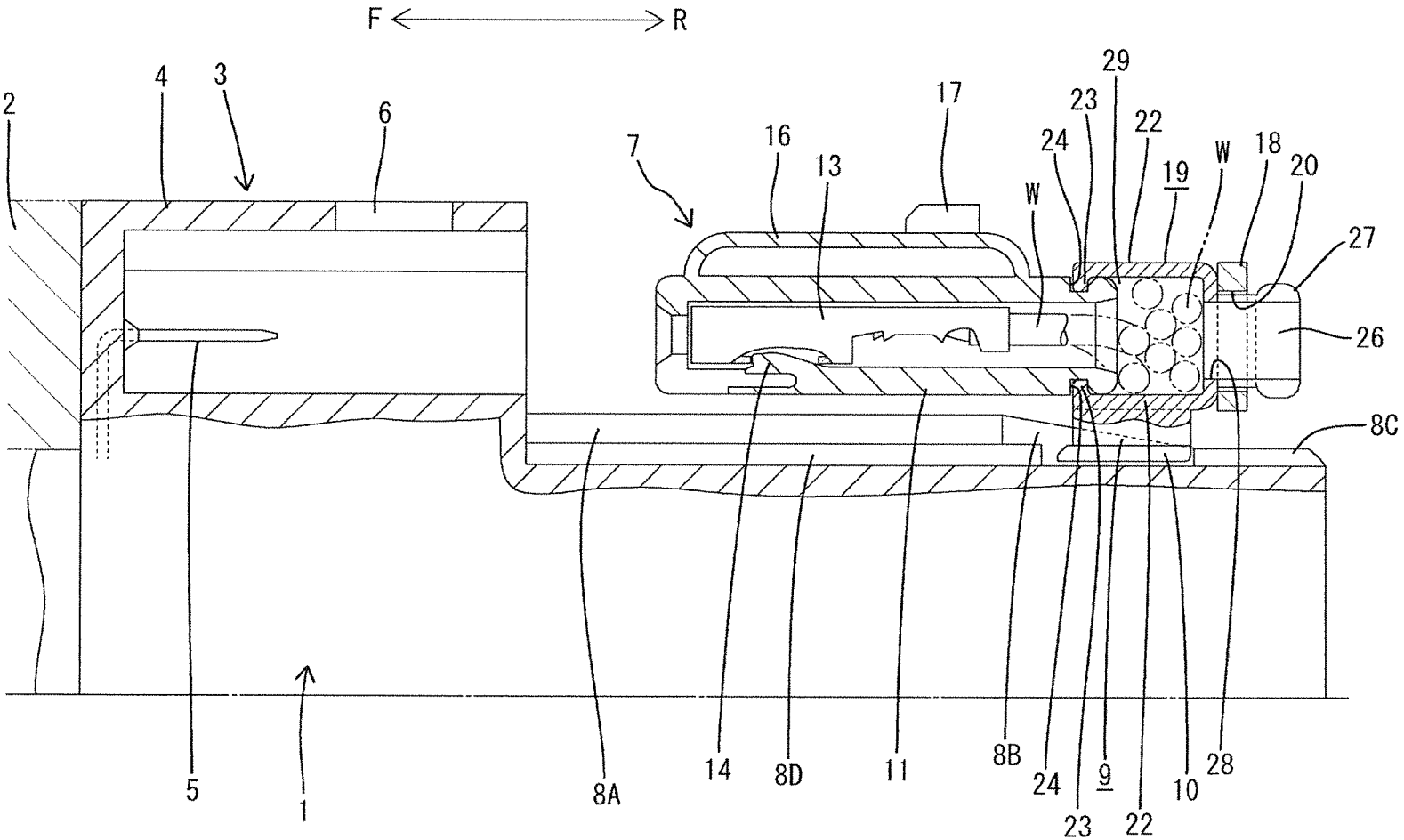
FIG. 6 is a side view in section showing a state while the holding-side connector is being connected to the device-side connector and where a guide portion is located in a guiding portion.

A device-side connector 3 is provided integrally on an upper front part of the outer peripheral surface of the solenoid 1, and the front surface thereof is in contact with the body 2. The device-side connector 3 includes a receptacle 4 made of synthetic resin. The receptacle 4 is in the form of a rectangular tube open rearward. As shown in FIGS. 3, 6 and the like, two device-side terminals 5 are incorporated into the device-side connector 3, and one end of each device-side terminal 5 projects into the receptacle 4 (only one side is shown in FIG. 6). The other end of the device-side terminal 5 is connected to an unillustrated coil accommodated inside the solenoid 1. Further, a substantially rectangular lock hole 6 penetrates through an upper wall of the receptacle 4 in the vertical direction (thickness direction of the upper wall).

Figure 4:
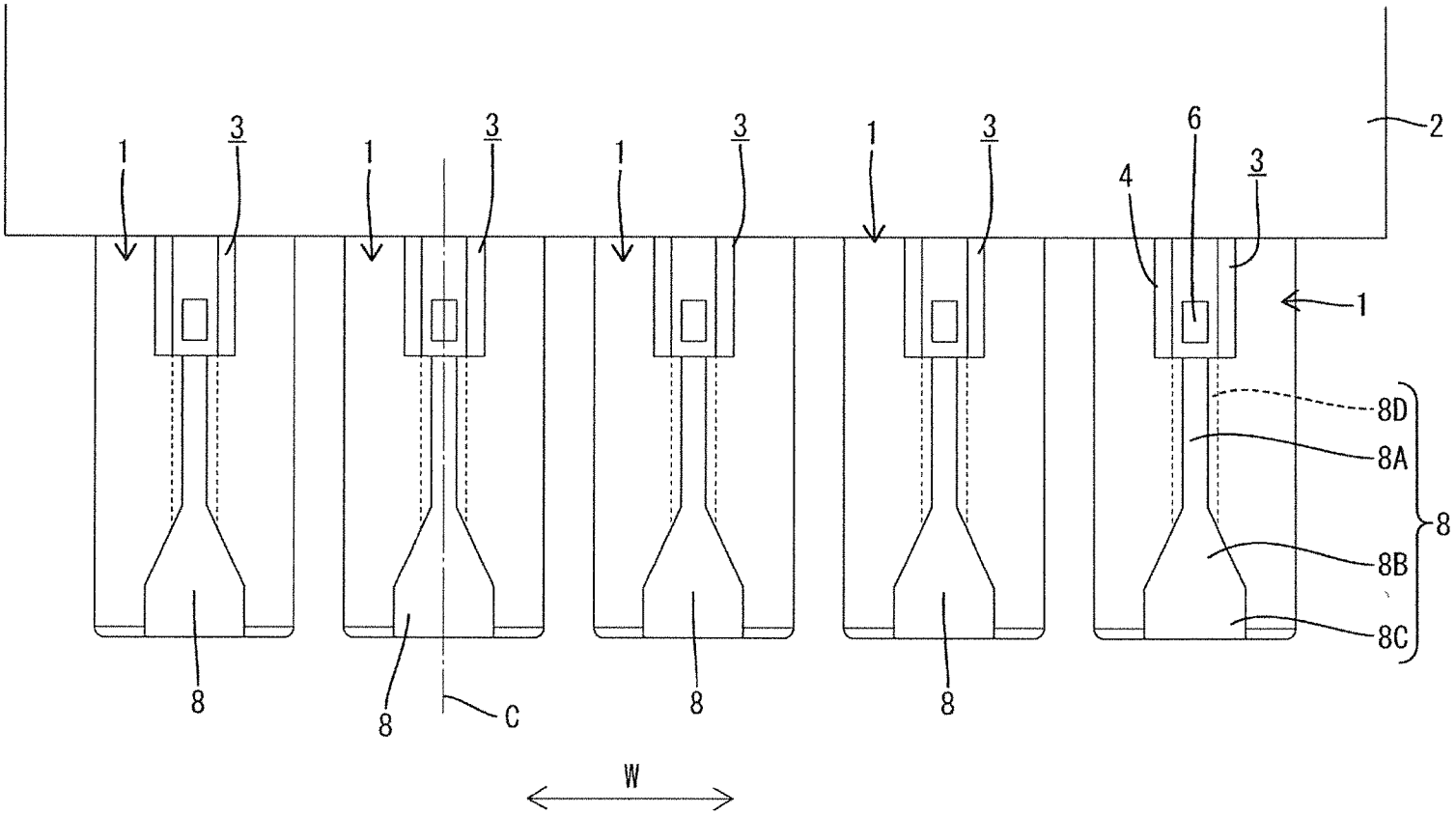
FIG. 4 is a plan view showing a state where the device-side connectors are mounted on electrical devices.

A guiding groove 8 (guiding portion) for guiding and connecting a holding-side connector 7 to be described later is recessed on an upper part of the outer peripheral surface of the solenoid 1 behind the device-side connector 3. The guiding groove 8 is located below a lower side of the opening edge of the receptacle 4 of the device-side connector 3. As shown in FIG. 4, a center axis C of the guiding groove 8 with respect to the width direction aligns with a center axis of the device-side connector 3 in the width direction. The guiding groove 8 is formed symmetrically across this center axis C.

Figure 8:
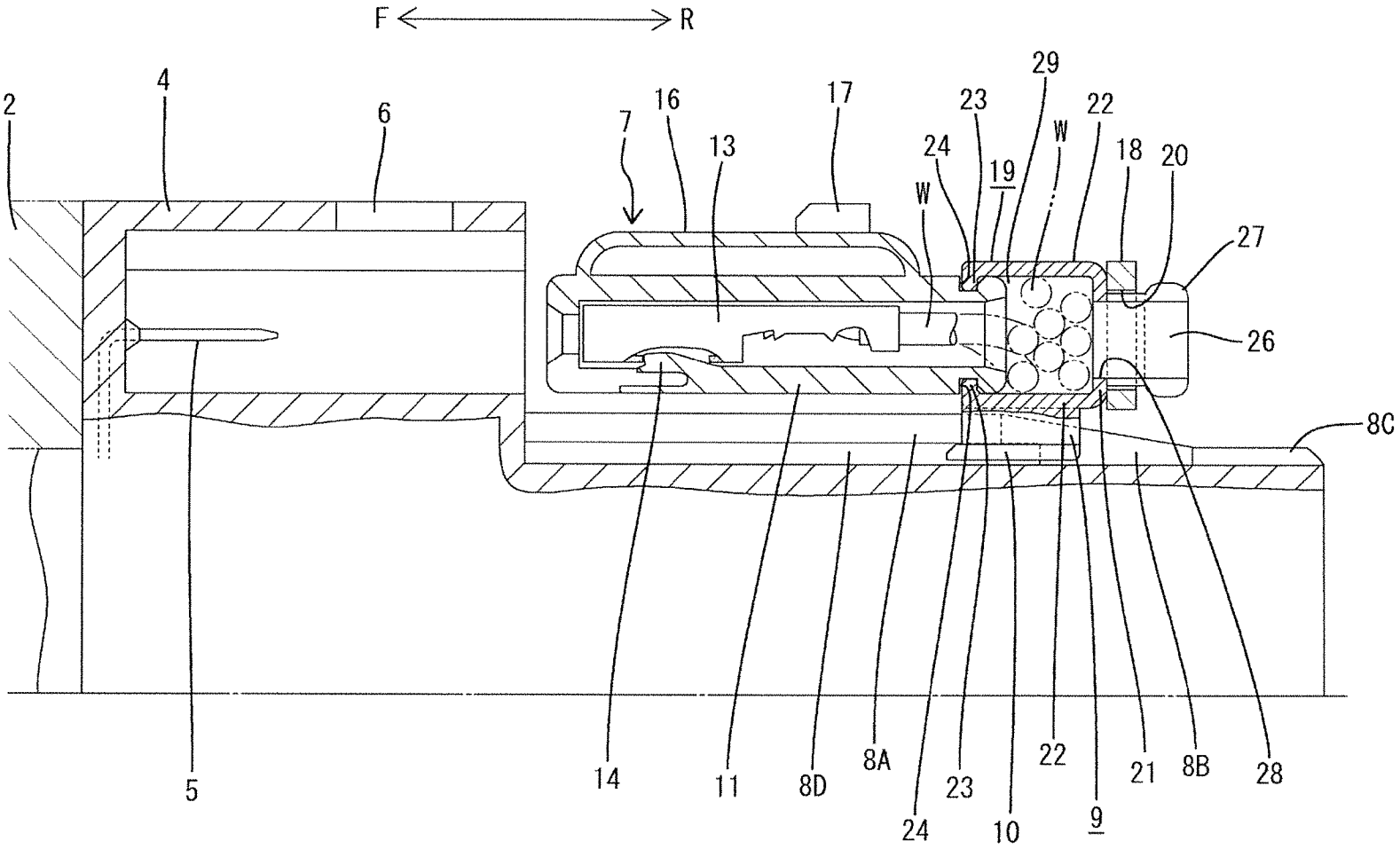
FIG. 8 is a side view in section showing a state while the holding-side connector is being connected to the device-side connector and where the guide portion is located at an entrance part of a positioning portion.

The guiding groove 8 is formed substantially along a connecting direction with the rear end of the solenoid 1 as a starting end and the rear surface of the device-side connector 3 as a finishing end. The bottom surface of the guiding groove 8 forms a horizontal surface and is at the same height over the entire length in the front-rear direction as shown in FIGS. 6 and 8.

Figure 9:
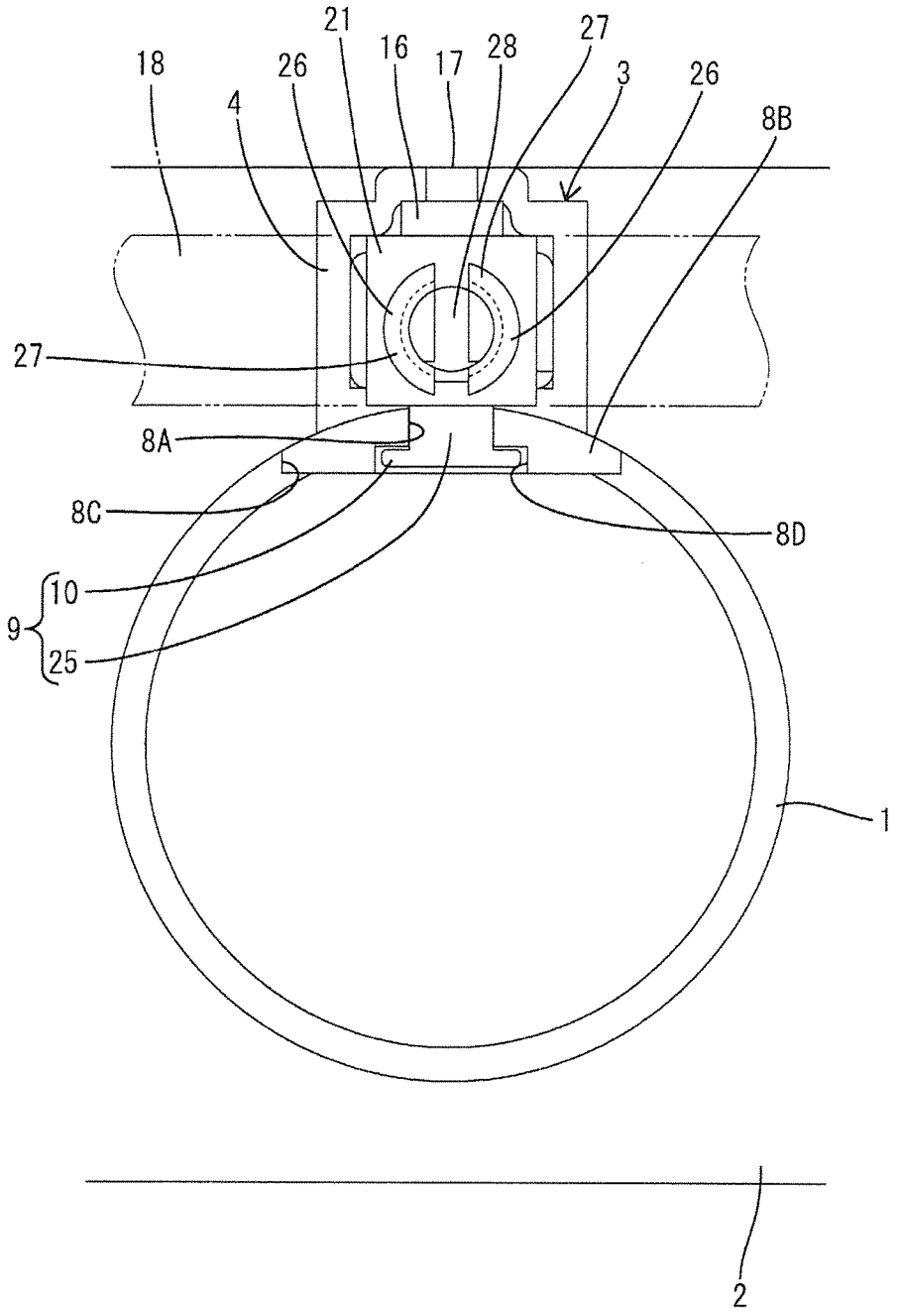
FIG. 9 is a front view in the state of FIG. 8.

As is clear from a plan view shown in FIG. 4, the guiding groove 8 includes a positioning portion 8A on a rear side (front side in the connecting direction) of the device-side connector 3. The positioning portion 8A extends straight while having a constant width over a predetermined length range along the front-rear direction. FIGS. 8 and 9 show a state immediately before a guide portion 9 on the holding-side connector 7 is inserted into the positioning portion 8A. As shown in FIGS. 8 and 9, the holding-side connector 7 is opposed to the device-side connector 3 immediately before connection.

The guiding groove 8 is formed with a guiding portion 8B continuously behind the positioning portion 8A. In a plan view (see FIG. 4), the guiding portion 8B is widened conically so that a groove width gradually increases toward a rear end. The guiding portion 8B is formed over a length range from a position separated forwardly by a predetermined distance from the rear end of the solenoid 1 to the rear end of the positioning portion 8A.

An entrance of the guiding groove 8, i.e. a range from the rear end of the guiding portion 8B to the rear end (chamfering 1A) of the solenoid 1, serves as a lead-in portion 8C. The lead-in portion 8C has a constant width equal to the groove width of the rear end of the guiding portion 8B. However, this lead-in portion 8C also has a groove width sufficient to absorb rattling in a circumferential direction allowed to be made by the solenoid 1 and each holding-side connector 7.

A flange locking portion 8D is recessed to communicate with this positioning portion 8A and widen the groove width toward both widthwise sides below the positioning portion 8A (side where the solenoid 1 is located). As shown in FIG. 6, the flange locking portion 8D extends from a front end location of the guiding portion 8B, i.e. an intermediate position of the guiding portion 8B slightly behind the entrance of the positioning portion 8A as a starting position. The flange locking portion 8D is formed over a length range from this starting position to a finishing end of the positioning portion 8A. The flange locking portion 8D is for locking a flange 10 of the guide portion 9 on the holding-side connector 7 to be described later.

Figure 2:
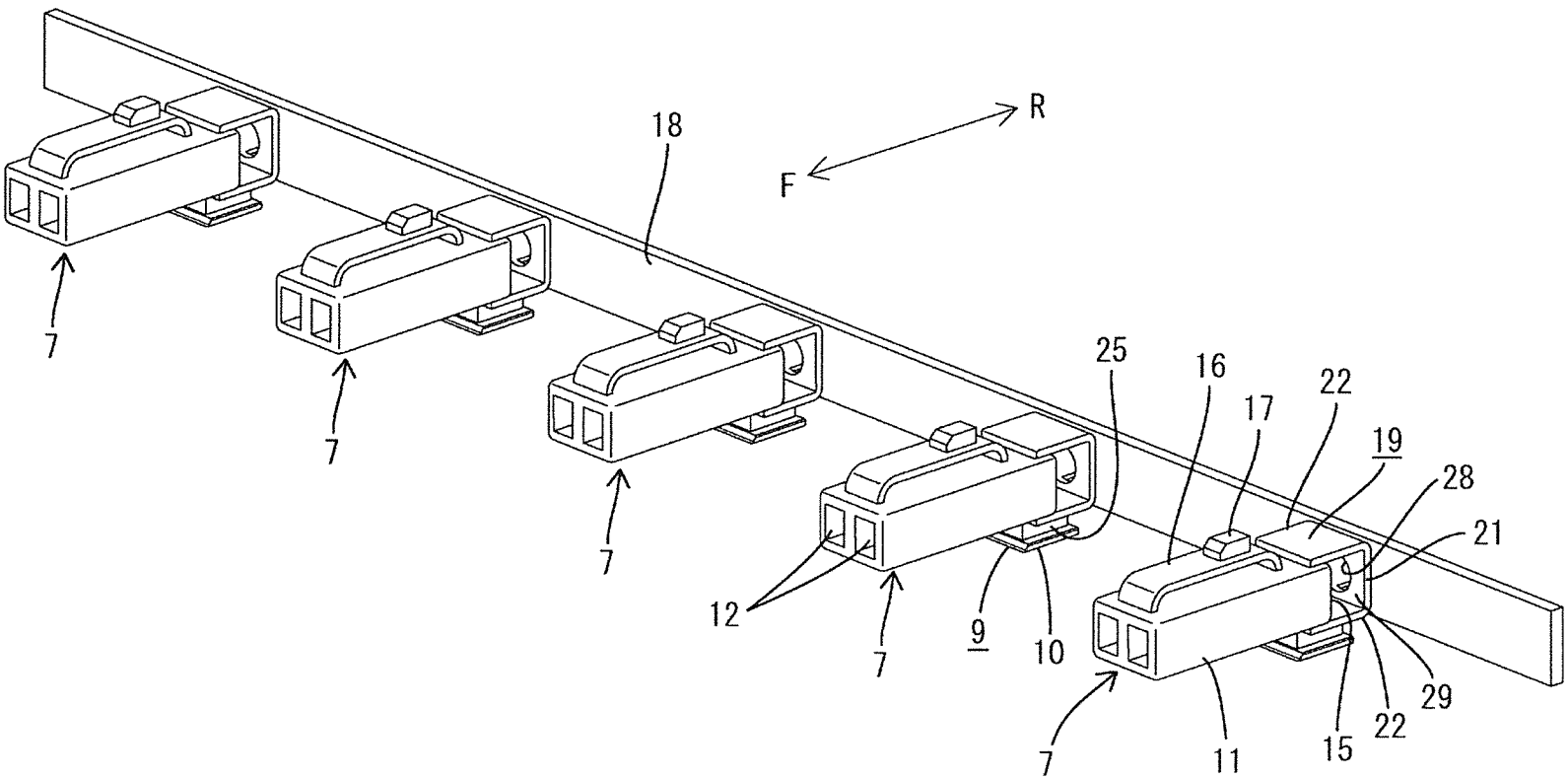
FIG. 2 is a perspective view showing a state where holding-side connectors are mounted on a holder.
Figure 5:
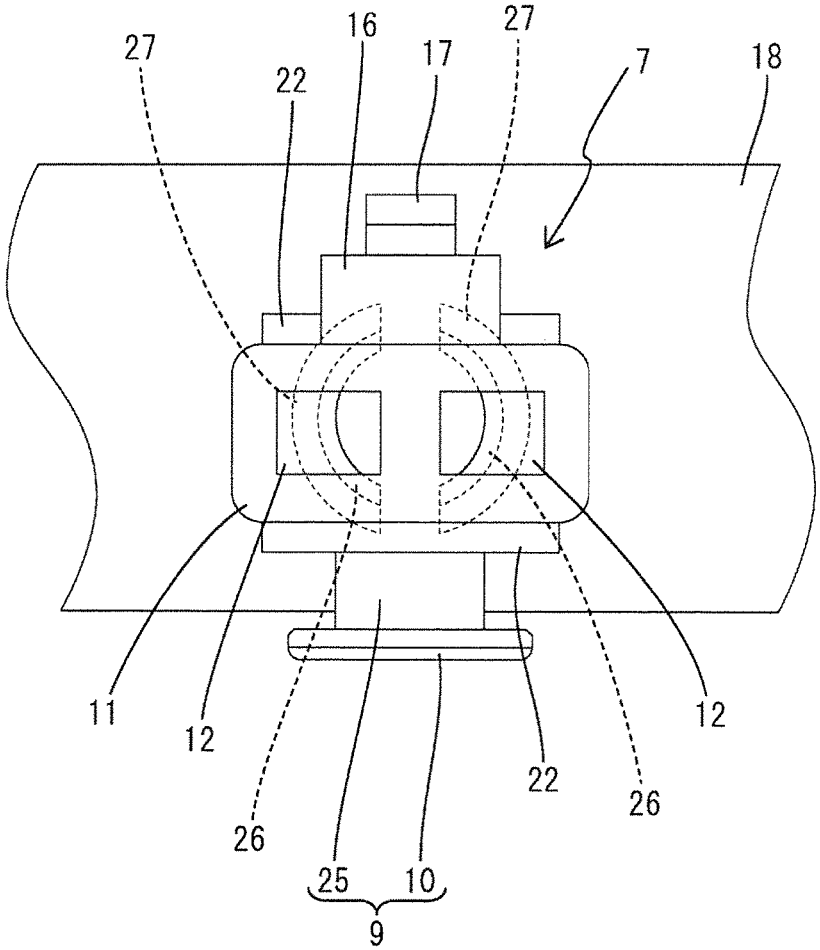
FIG. 5 is a front view showing the state where the holding-side connector is mounted on the holder.
Figure 11:
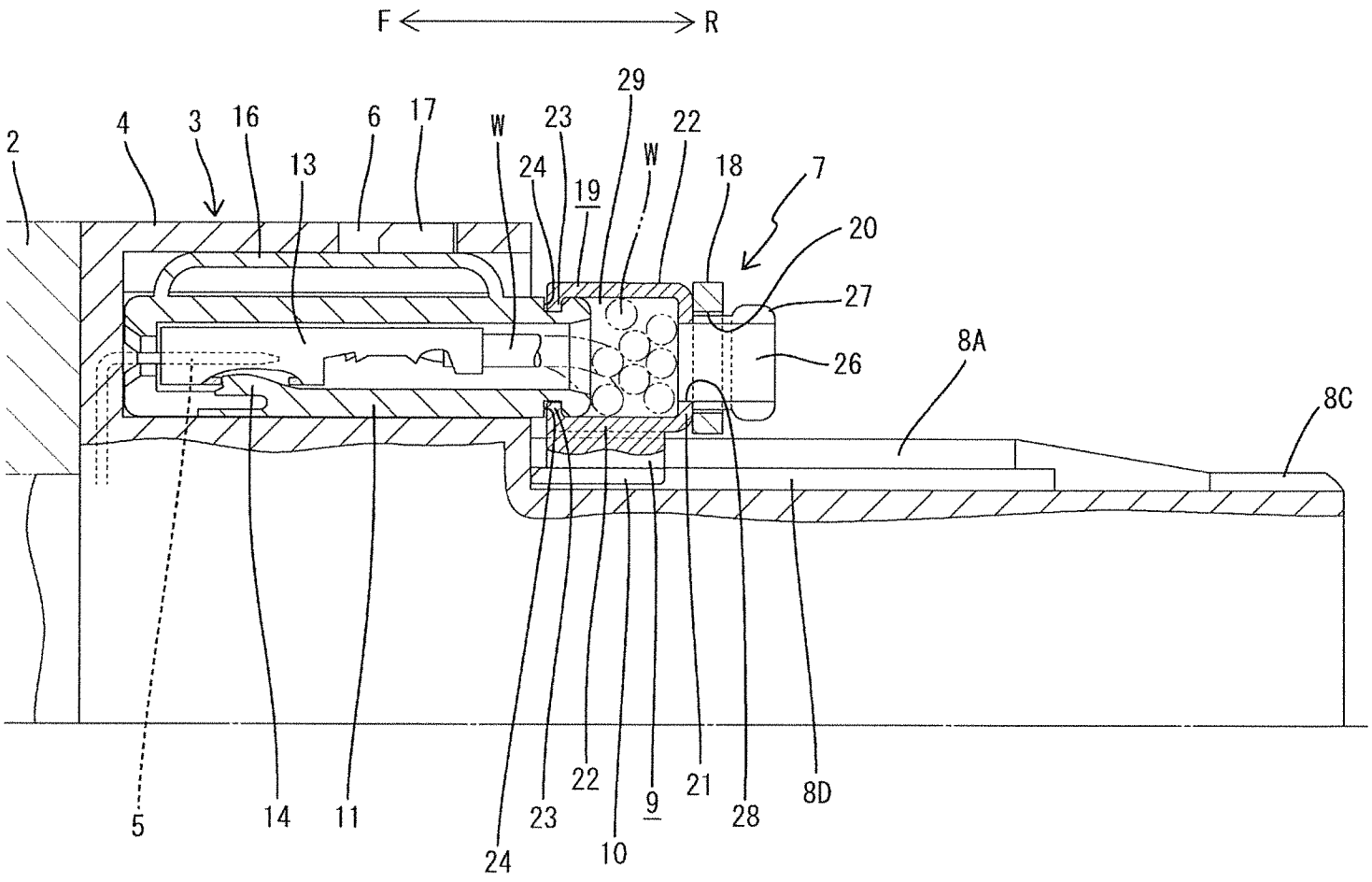
FIG. 11 is a side view in section in the state of FIG. 10.

The holding-side connector 7 includes a housing 11 made of synthetic resin. As shown in FIG. 2, the housing 11 has a rectangular parallelepiped shape long in the front-rear direction. As shown in FIG. 5, two cavities 12 are provided in the width direction inside the housing 11. Each cavity 12 penetrates through the housing 11 in the front-rear direction, and a holding-side terminal 13 is inserted inside the cavity 12, as shown in FIGS. 6, 8 and 11. A deflectable locking lance 14 is provided on the bottom surface in the cavity 12 near the front and resiliently locks the holding-side terminal 13 in a retained state The rear surface of the housing 11 serves as a wire pull-out surface 15 from which wires W are pulled out.

The holding-side terminal 13 is formed by bending a conductive metal plate. A front end part of the holding-side terminal 13 forms a rectangular tube, and the device-side terminal 5 is inserted therein for connection when the connectors 3, 7 are connected. A rear end part of the holding-side terminal 13 forms an open barrel that is caulked and connected to a core exposed at an end of the wire W.

A lock arm 16 is provided along the front-rear direction on the upper surface of the housing 11. The lock arm 16 has a beam structure supported on both front and rear ends connected to the upper surface of the housing 11 and is deflectable in the vertical direction. A lock projection 17 projects at a position near a rear end part on the upper surface of the lock arm 16. The lock arm 16 is deflected and deformed down when the device-side connector 3 and the holding-side connector 7 are connected. The lock arm 16 resiliently returns as the connection is completed (state of FIG. 11), and the lock projection 17 is fit into the lock hole 6 to be locked. In this way, the holding-side connector 7 is locked in a state connected to the device-side connector 3.

As shown in FIG. 2, the holding-side connectors 7 are mounted in parallel in the width direction on a holder 18. An arrangement interval of the holding-side connectors 7 is equal to that of the device-side connectors 3. In this embodiment, each holding-side connector 7 is mounted on the holder 18 via a coupling member 19 provided for each holding-side connector 7.

The holder 18 is, for example, made of metal (may be made of resin) and is a plate long in the width direction, as shown in FIG. 2. Mounting holes 20 (e.g. having a circular shape) penetrate through the holder 18 substantially at the same intervals as the device-side connectors 3.

Figure 7:
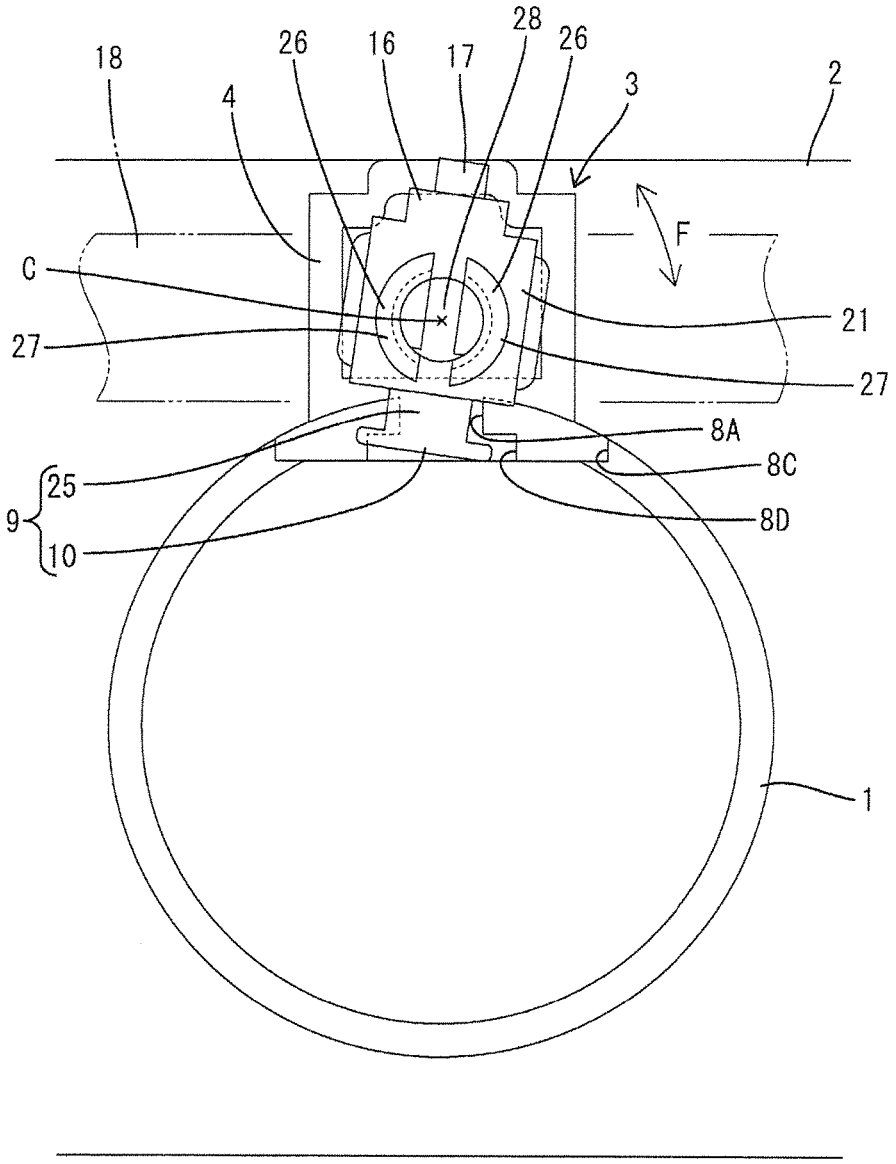
FIG. 7 is a front view in the state of FIG. 6.

The coupling member 19 is made of synthetic resin and includes a base plate 21 arranged between the rear surface (wire pull-out surface 15) of the holding-side connector 7 and the holder 18 and is held in close contact with the front surface side of the holder 18. The base plate 21 has a rectangular shape, and a circular through hole 28 penetrates through a central part of the base plate 21, as shown in FIGS. 7 and 9. Two retaining pieces 26 project rearward on the rear surface of the base plate 21 to sandwich the through hole 28 in the width direction. The retaining pieces 26 face each other in the width direction and can be deflected and deformed (narrowing deformation) toward each other. The retaining pieces 26 are deformed to narrow a distance therebetween, thereby being able to be inserted into the mounting hole 20 of the holder 18. Further, locking edges 27 protrude along the same edges on the outer peripheral surfaces of leading edges of the retaining pieces 26. With the retaining pieces 26 inserted in the mounting hole 20, the locking edges 27 are resiliently locked to the hole edge of the mounting hole 20 *s* that each holding-side connector 7 is juxtaposed with the other holding-side connectors 7 on the holder 18 via the coupling member 19.

The retaining pieces 26 are structured to be locked resiliently into the circular mounting hole 20 in this embodiment. Thus, each holding-side connector 7 is in a mounted state where rotation about a center axis (axis, C of FIG. 7) along the front-rear direction along which the holding-side connector 7 passes the mounting hole 20 is allowed, but postures of all the holding-side connectors 7 in the circumferential direction substantially align before connection to the device-side connectors 3. Further, an angle of rotation allowed for each holding-side connector 7 is larger than an angle of rotation allowed for each solenoid 1.

Two coupling plates 22 are formed on upper and lower edges of the base plate 21 to vertically face each other. Both side surfaces of the coupling member 19 are open in the width direction and serve as a wire draw-out opening 29 for laterally drawing out the wires W (see FIGS. 2, 6).

The coupling plates 22 are cantilevered forward and are vertically deflectable. The coupling plates 22 are formed to be slightly narrower than the housing 11. Locking ridges 23 project on leading edges (front end edges) of the coupling plates 22 and vertically face each other. On the other hand, two locking grooves 24 are recessed along the width direction at positions near a rear end part on both upper and lower surfaces of the housing 11. The coupling member 19 is mounted on the housing 11 by resiliently locking the locking ridges 23 to the locking grooves 24 while vertically sandwiching the rear end part of the housing 11 by the coupling plates 22.

The guide portion 9 projects in a widthwise central part of the lower surface of the lower coupling plate 22 (see FIGS. 6, 8, 11) and extends in the front-rear direction over substantially the entire length of the lower coupling plate 22. As shown in FIG. 5, the guide portion 9 is composed of a base 25 projecting down from the widthwise central part of the lower coupling plate 22 and the flange 10 protruding out from the lower end of this base 25.

The base 25 and the flange 10 are formed to have a constant width over the entire length. The base 25 has a width substantially equal to or slightly smaller than the width of the positioning portion 8A in the guiding groove 8. With the base 25 fit in the positioning portion 8A, the holding-side connector 7 is positioned in a posture to be opposed to the corresponding device-side connector 3.

As shown in FIG. 5, the flange 10 protrudes out in the width direction from the lower end of the coupling plate 22 and also protrudes forward (see FIGS. 6, 8 and 11). Protruding widths toward these three sides are substantially equal. Further, a width between both outer ends of the flange 10 in the width direction is set equal to or slightly smaller than the width of the flange locking portion 8D. Thus, the flange 10 can be inserted into the flange locking portion 8D. Even if the holding-side connector 7 is in an oblique posture by rotating about the center axis as shown in FIG. 7 immediately before the insertion is started, the holding-side connector 7 can be posture-corrected to be opposed to the device-side connector 3, as shown in FIG. 9, by starting the insertion of the flange 10 into the flange locking portion 8D.

The upper surface of a part of the flange 10 protruding forward is chamfered to incline down toward the front, as shown in FIG. 8. Further, the upper surfaces of parts of the flange 10 protruding out in the width direction are flat surfaces.

The holding-side connectors 7 mounted on the holder 18 are connected to the respective device-side connectors 3 by causing the holding-side connectors 7 to face the corresponding device-side connectors 3. At this time, each holding-side connector 7 may be oblique to the holder 18, as shown in FIG. 7, and the angle of rotation thereof about the center axis (see C of FIG. 7) may vary individually. Similarly, although not shown, the angle of rotation of each solenoid 1 about the center axis also may vary individually. Thus, each device-side connector 3 may not be opposed to the corresponding holding-side connector 7.

Under the circumstances described above, the holding-side connectors 7 are moved forward at once together with the holder 18 toward the corresponding device-side connectors 3. At this time, even if the respective holding-side connectors 7 are not opposed to the corresponding device-side connectors 3, as described above, the flanges 10 of the guides 9 on the respective holding-side connectors 7 are introduced into the lead-in portions 8C of the corresponding guiding grooves 8 since the lead-in portions 8C of the guiding grooves 8 have a groove width sufficient to absorb rotational position variations of the corresponding connectors, as described above. Subsequently, the respective holding-side connectors 7 are moved farther forward toward the corresponding device-side connectors 3 with the flanges 10 held in contact with the upper surfaces of the lead-in portions 8C.

FIG. 6 shows a state where the flange 10 is located in the guiding portion 8B according to the above-described forward movement. At this time, each holding-side connector 7 has not reached the corresponding device-side connector 3 yet, as shown in FIG. 6, and is separated rearwardly from the device-side connector 3. Further, FIG. 7 shows a situation where the holding-side connector 7 is displaced rotationally in the circumferential direction (F of FIG. 7) by a predetermined angle about the center axis from a proper posture and is in an oblique posture.

While the flange 10 passes through the guiding portion 8B, the device-side connector 3 has the posture thereof gradually corrected to the proper posture together with the solenoid 1 since widthwise side edges of the flange 10 slide in contact with side edges in the guiding portion 8B while the flange 10 passes through the guiding portion 8B even if the solenoid 1 is displaced about the axial center from the proper posture and the device-side connector 3 is inclined in the circumferential direction (direction similar to F of FIG. 7).

When each holding-side connector 7 moves farther forward and the front end of the flange 10 comes to the entrance of the positioning portion 8A, the flange 10 is inserted into the entrance of the flange locking portion 8D slightly before the base 25 of the guide 9 enters the positioning portion 8A. Thus, as shown in FIG. 9, each holding-side connector 7 rotates from the oblique posture, is corrected to the proper upright posture and has an upward displacement restricted. In addition, the solenoid 1 and the device-side connector 3 also are set in a proper posture.

By completing the correcting operation of the corresponding connectors 3, 7, as described above, the corresponding connectors 3, 7 are opposed to each other at once.

Figure 10:
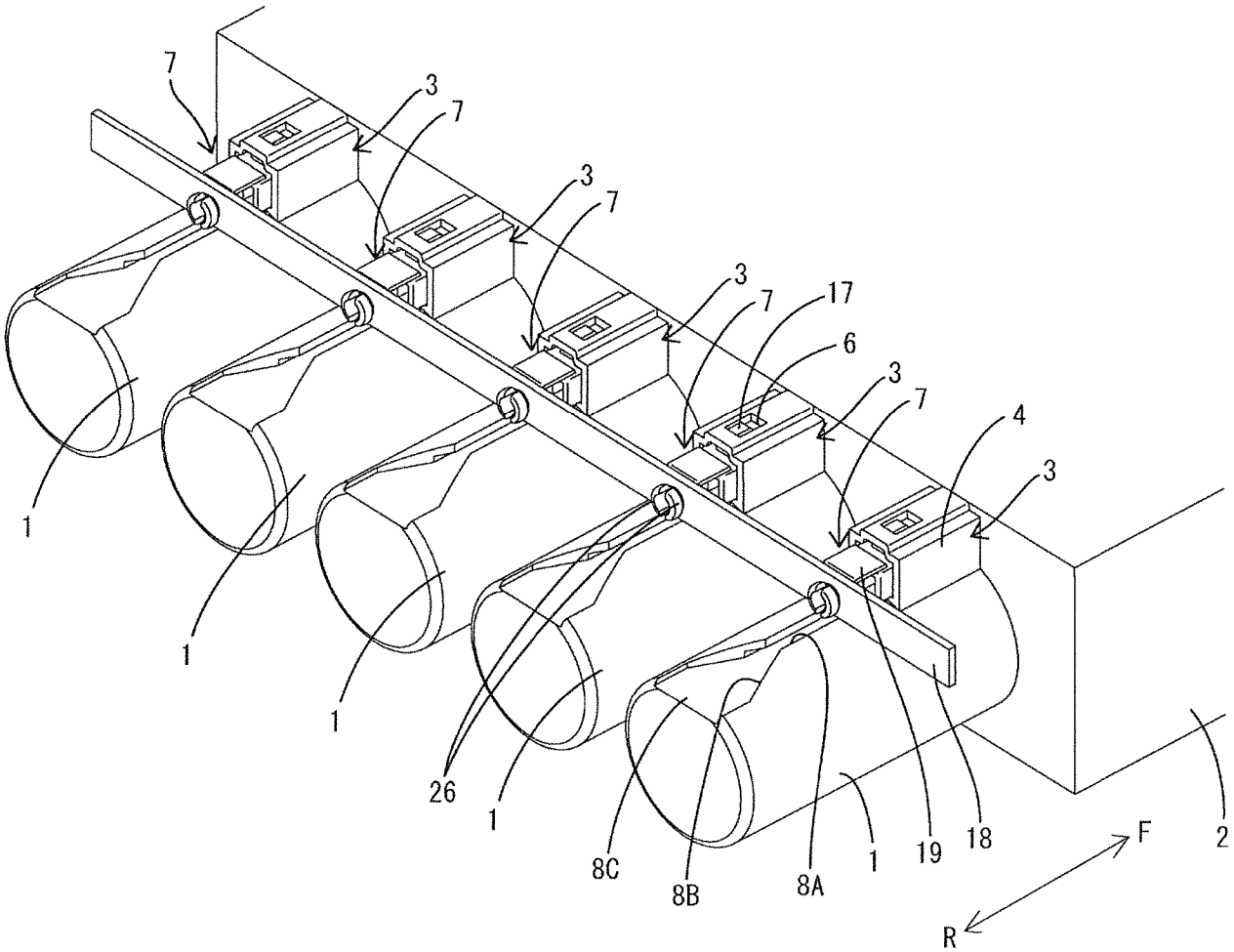
FIG. 10 is a perspective view showing a state where collective connection of the device-side connectors and the holding-side connectors is completed.

The bases 25 of the guides 9 enter the positioning portions 8A as the holding-side connectors 7 continue to move forward. Therefore, the respective holding-side connectors 7 move forward while being held opposed to the corresponding device-side connectors 3. Thus, the corresponding connectors 3, 7 reliably reach a properly connected state (state of FIGS. 10 and 11). The lock arms 16 are deflected and deformed while the corresponding connectors 3, 7 are being connected, but resiliently return when proper connection is reached so that the lock projections 17 are locked to the lock holes 6. As a result, the corresponding connectors 3, 7 are locked collectively in the connected state, and the device-side terminals 5 and the holding-side terminals 13 are connected properly.

The postures of both the device-side connector 3 and the holding-side connector 7 may vary in the circumferential direction. However, these variations can be absorbed and the corresponding connectors 3, 7 can be connected smoothly and properly. The structure for guiding the connection of the connectors 3, 7 is not provided on the connector 3 itself, but on the solenoid 1 in this embodiment. Specifically, the device-side connector 3 itself needs no guiding structure, which contributes to the miniaturization of the device-side connector 3.

Further, since each holding-side connector 7 is mounted on the holder 18 via the coupling member 19 and this coupling member 19 is formed with the guide portion 9, the holding-side connector 7 having an existing structure can be utilized.

Furthermore, the flange 10 is formed on the base 25 in the guide 9 to avoid a situation where the center axes of the corresponding connectors 3, 7 are deviated in the vertical direction. In addition, if the flange 10 is not formed and positioning is performed only by fitting the base 25 and the positioning portion 8A, the base 25 may be inserted obliquely into the positioning portion 8A depending on rattling between the both connectors 3, 7 in the circumferential direction. However, in the structure added with the fitting of the flange 10 and the flange locking portion 8D, as in this embodiment, a positional deviation between the connectors 3, 7 in the circumferential direction can be corrected reliably. Thus, the base 25 can be corrected to an upright posture and can be fit smoothly into the positioning portion 8A. Therefore, the guiding groove 8 can smoothly and reliably act to guide the guide portion 9.

The invention is not limited to the above described and illustrated embodiment. For example, the following embodiments also are included in the scope of the invention.

Although the circular mounting holes 20 of the holder 18 are shown in the above embodiment, an angle range in which rotation is allowed may be made smaller by forming the mounting holes 20 into rectangular holes.

Although the coupling member 19 is formed with the guide 9 in the above embodiment, the holding-side connector 7 itself may be formed with the guide 9.

Although the guide 9 includes the flange 10 in the above embodiment, the guide 9 may be composed only of the base 25 without including the flange 10. In such a case, the flange locking portion 8D need not be formed in the guiding groove 8.

Although both the device-side connector 3 and the holding-side connector 7 are allowed to rattle in the circumferential direction in the above embodiment, only one of these may be allowed to rattle.

LIST OF REFERENCE SIGNS

1 . . . solenoid (electrical device)
3 . . . device-side connector
7 . . . holding-side connector
8 . . . guiding groove (guiding portion)
8A . . . positioning portion
8D . . . flange locking portion
9 . . . guide
10 . . . flange
15 . . . wire pull-out surface
18 . . . holder
19 . . . coupling member
25 . . . base
29 . . . wire draw-out opening

The invention claimed is:

1. A connector device, comprising:

device-side connectors respectively installed on outer surfaces of electrical devices juxtaposed in a width direction;

holding-side connectors connectable respectively to the corresponding device-side connectors by moving forward from behind the respective device-side connectors and allowed to relatively rotate about axes along a front-rear direction with respect to the device-side connectors;

a holder configured to couple the respective holding-side connectors in a state juxtaposed in the width direction and enabling the respective holding-side connectors to be connected collectively to the corresponding device-side connectors;

provided for the respective holding-side connectors on a side where the holding-side connectors are located;

guiding portions provided to extend in the front-rear direction behind the respective device-side connectors on the outer surfaces of the electrical devices and configured to guide the connection of the holding-side connectors and the device-side connectors by being fit to the respective guide; and coupling members provided between the respective holding-side connectors and the holder and configured to couple the respective holding-side connectors to the holder.

2. The connector device of claim 1, wherein each of the guiding portions is in the form of a groove widened toward a rear side on the outer surface of the electrical device.

3. The connector device of claim 1, wherein:

a wire is pulled out from a rear surface of each of the of holding-side connectors; and each of the coupling members includes two coupling plates facing each other between the rear surface of the corresponding one of the holding-side connector and the holder and a wire draw-out opening configured to draw the wire outwardly of the coupling member is open between the two coupling plates.

4. The connector device of claim 3, wherein each of the guide is provided on each of the coupling members.

5. The connector device of claim 4, wherein:

each of the guide includes a base projecting from the corresponding one of the coupling members toward a side where the electrical device is located and a flange protruding out in a width direction from a front end part of the base; and each of the guiding portions is in the form of a groove on the outer surface of the electrical device and includes, on a front part, a positioning portion configured to position the corresponding one of the holding-side connectors in a circumferential direction about the axis by being fit to the base and, on a groove bottom side of the positioning portion, a flange locking portion communicating with the positioning portion, shaped to have a wider groove width in the width direction than the positioning portion and configured to lock the flange inserted therein.

* * * * *